US006336512B1

(12) United States Patent
Siracki et al.

(10) Patent No.: US 6,336,512 B1
(45) Date of Patent: Jan. 8, 2002

(54) DRILL BIT HAVING CANTED SEAL

(75) Inventors: Michael A. Siracki; Steven W. Peterson; Chris E. Cawthorne, all of The Woodlands; Quan V. Nguyen, Houston, all of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/495,602

(22) Filed: Feb. 1, 2000

Related U.S. Application Data

(60) Provisional application No. 60/118,239, filed on Feb. 2, 1999.

(51) Int. Cl.[7] ..... E21B 10/08

(52) U.S. Cl. ..... 175/371; 175/331; 384/94

(58) Field of Search ..... 175/331, 359, 175/371; 384/92, 94; 227/336

(56) References Cited

U.S. PATENT DOCUMENTS

| | | | | | |
|---|---|---|---|---|---|
| 3,096,835 | A | * | 7/1963 | Neilson | |
| 3,680,873 | A | * | 8/1972 | Garner | |
| 4,623,028 | A | * | 11/1986 | Murdoch et al. | 175/371 |
| 4,903,786 | A | * | 2/1990 | Welsh | 175/367 |
| 5,016,719 | A | | 5/1991 | White | 175/353 |
| 5,129,471 | A | * | 7/1992 | Maurstad et al. | 175/228 |
| 6,026,917 | A | * | 2/2000 | Zahradnik et al. | 175/371 |

* cited by examiner

*Primary Examiner*—David Bagnell
*Assistant Examiner*—Jennifer Dougherty
(74) *Attorney, Agent, or Firm*—Conley, Rose & Tayon, P.C

(57) ABSTRACT

A drill bit having a canted or non-canted leg backface, a canted or non-canted seal in the interface between the cone backface and the shirttail, and a canted seal that can be semi-encapsulated so that there is no straight-line path across the seal.

29 Claims, 4 Drawing Sheets

DRILL BIT HAVING CANTED SEAL

RELATED APPLICATIONS

The present application claims the benefit of U.S. application Ser. No. 60/118,239, filed Feb. 2, 1999, and entitled Drill Bit, which is hereby incorporated by reference in its entirety.

TECHNICAL FIELD OF THE INVENTION

The present invention relates generally to sealed bearing earth boring drill bits, such as rotary cone rock bits. More particularly, the present invention relates to the seals that are used to seal the bearing area between the bit leg and the rolling cone. Still more particularly, the present invention relates to a seal that is canted or angled with respect to the bearing axis and also to a canted leg/cone interface.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone typical earth-boring bit includes one or more rotatable cutters, or cones. The cutters roll and slide upon the bottom of the borehole as the bit is rotated, thereby engaging and disintegrating the formation material in the bit's path. The rotatable cutters may be described as generally conical in shape and are therefore sometimes referred to as rolling cones.

Bits designed to work with rolling cones typically include a bit body with a plurality of journal segment legs. The rolling cones are mounted on bearing pin shafts that extend downwardly and inwardly from the journal segment legs. The borehole is formed as the gouging and scraping or crushing and chipping action of the rotary cones removes chips of formation material. The chips are carried upward and out of the borehole by drilling fluid that is pumped downwardly through the drill pipe and out of the bit. The drilling fluid carries the chips and cuttings in a slurry as it flows up and out of the borehole.

In a typical bit, the earth-disintegrating action of the rolling cone cutters is enhanced by providing the cones with a plurality of cutting elements. Cutting elements are generally of two types: inserts formed of a very hard material, such as tungsten carbide, that are press fit into undersized apertures in the cone surface; or teeth that are milled, cast or otherwise integrally formed from the material of the rolling cone.

The cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is always desirable to employ drill bits that will drill faster and longer without failing.

The length of time that a drill bit can be employed before it must be replaced depends on many factors, not the least of which is its ability to resist the wear associated with drilling. All of the components of a bit are subjected to severe wear, as a result of frictional contact with the formation and the drilling fluid. While wear can damage any surface of the bit, the bearing surfaces of the bit, namely those between each journal segment and its associated cone, are particularly vulnerable. If grit or other particles were to enter the annular space between the cone and the journal while the bit was rotating, the bearing surfaces would be quickly destroyed, rendering the bit unusable.

For this reason, a great deal of attention has been given to providing a sealing system that prevents the ingress of particles to the bearing surface. It is desirable to provide a sealing system that does not take up too much of the available space on the bit leg, yet provides a good seal. It is further desired to provide a bit that has superior wear resistance and can accommodate additional wear resisting features.

SUMMARY OF THE INVENTION

The present invention provides a sealing system that prevents the ingress of particles to the bearing surface and does not take up too much of the space needed for the bearings. The present invention further results in a bit that has superior wear resistance and can accommodate additional wear resisting features. In one preferred embodiment, the present bit includes a canted bearing seal whose operating axis is neither parallel nor perpendicular to the bearing axis. The canted bearing seal can be used alone or in combination with additional canted or conventional seals. In another embodiment, the present invention includes a bit having a canted interface between the bit leg and the cone backface. In still another embodiment, the present invention includes a bearing seal that is mounted in a groove in the cone and a corresponding cut-out in the leg, so that there is no straight-line path past the seal.

One embodiment of the present invention comprises bit that comprises a bit body having at least one leg having a journal segment extending inwardly and downwardly therefrom and at least one rolling cone cutter rotatably mounted on the bit body and having a generally conical outer surface and a cone backface. The leg includes a shirttail, and the shirttail has an outer surface and a leg backface that defines an interface with said cone backface and the leg backface is canted.

In another embodiment, the present bit comprises a bit body and at least one rolling cone cutter rotatably mounted on said bit body. The body has at least one leg having a journal segment extending inwardly and downwardly therefrom, the leg including a shirttail, and the shirttail having an outer surface and a canted leg backface. The rolling cone cutter has a generally conical outer surface and a cone backface, and the backface defines an interface with the shirttail inner surface and a seal is positioned in said interface. This embodiment can be used with a recessed or non-recessed shirttail and a convention or a non-positive seal.

Still another embodiment comprises a bit body, at least one rolling cone cutter rotatably mounted on said bit body. The body having at least one leg having a journal segment extending inwardly and downwardly therefrom, said leg including a shirttail, said shirttail having an outer surfaces and a leg backface. The rolling cone cutter has a bearing axis, a generally conical outer surface, and a cone backface. The cone backface defines an interface with said shirttail inner surface and a canted seal is positioned in the interface.

The seal has an operating axis that is a canted with respect to said bearing axis.

BRIEF DESCRIPTION OF THE DRAWINGS

For a more complete understanding of the present invention, reference will now be made to the accompanying Figures, wherein.

DETAILED DESCRIPTION OF THE PREFERRED EMBODIMENTS

Figure 1:
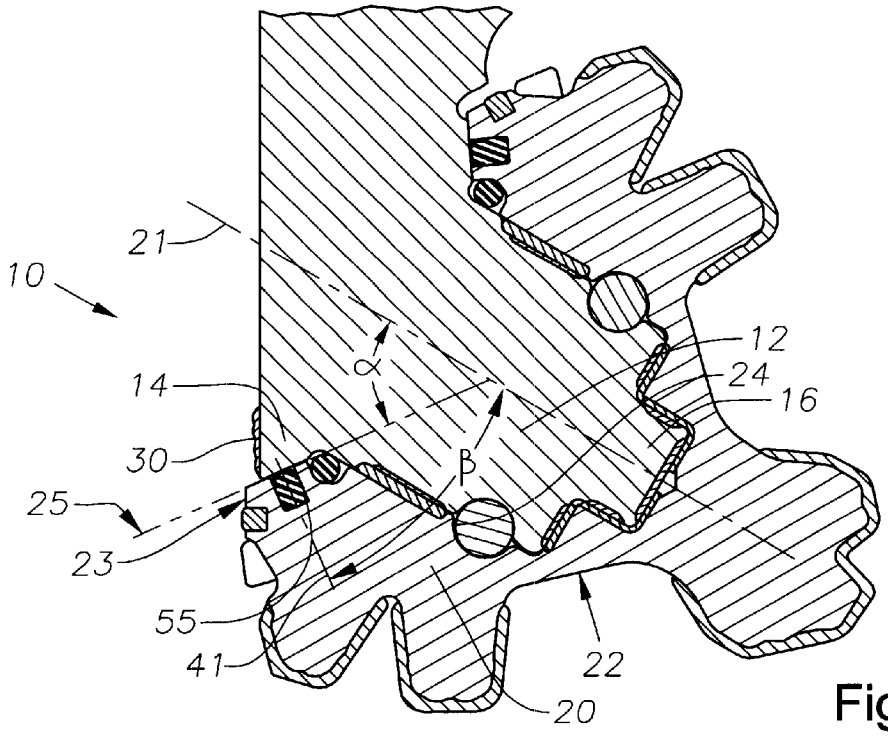
FIG. 1 is a cross-sectional view of a bit leg and associated cone constructed in accordance with the present invention, wherein the leg backface is canted, the seal is canted, and the seal is received in a groove in the cone.
Figure 2:
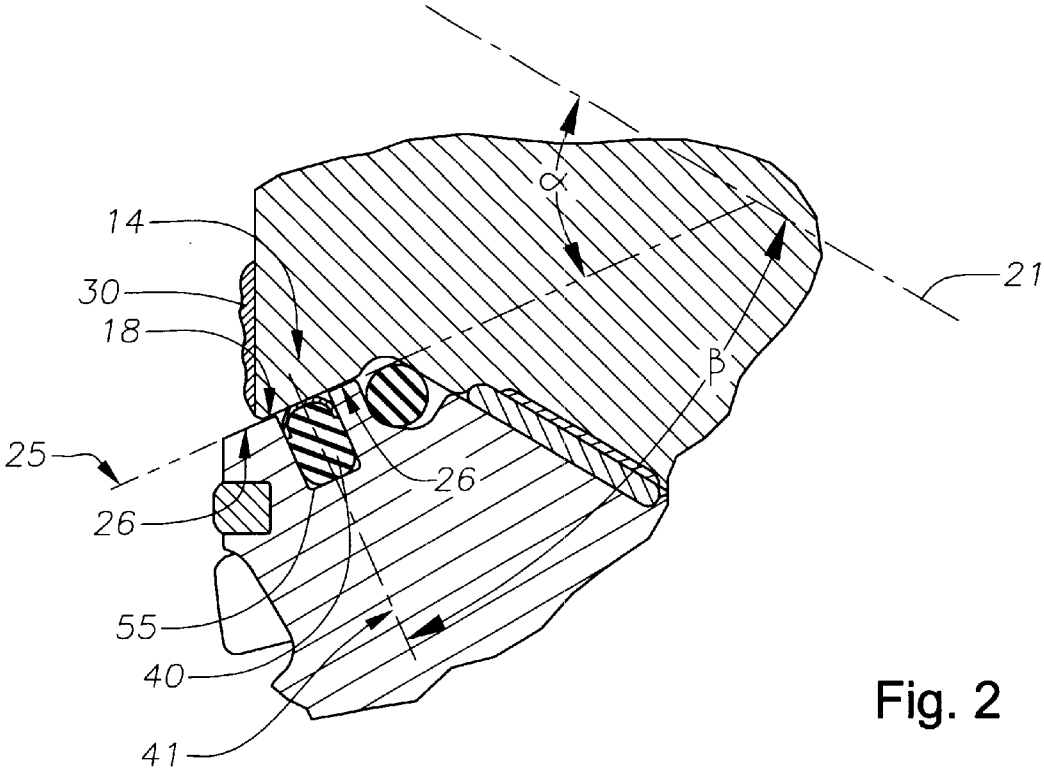
FIG. 2 is an enlarged view of the seal of FIG. 1.

Referring initially to FIGS. 1 and 2, a drill bit leg 10 includes a journal segment 12, a shirttail 14 and a bearing end 16. Shirttail 14 includes a leg backface surface 18. The corresponding cone 20 mounted on journal segment 12 includes a generally conical outer surface 22, a heel surface 23, a stepped inner journal surface 24, and a cone backface 26. A plurality of journal and/or ball bearings 32, 34 are provided in the annular recess 13 between the cone 20 and the journal segment 12 and allow cone 20 to rotate about the bearing axis 21, as is conventional in the art. It is these bearing components that the present invention protects.

Specifically, according to the embodiment shown in FIGS. 1 and 2, a canted leg backface 18 is used in conjunction with a canted seal ring 40. By "canted" it is meant that a line 25 along at least a substantial portion of the backface, as drawn in FIG. 1, is not normal to the bearing axis 21. In particular, this is not intended to cover that portion of the backface adjacent to the journal that forms a transition from the journal segment to the leg backface. Conversely, the term "non-canted" is defined to mean that line 25 as drawn in FIG. 1 is normal to the bearing axis 21. In this embodiment, canted backfaces 18 and 26 each form a straight line as drawn in cross-section and each backface is frustoconical.

Still referring to FIGS. 1 and 2, backface line 25 defines an angle a with respect to bearing axis 21. In a preferred embodiment, angle $\alpha$ is between 35 and 85 degrees, with a preferred range being between 45 and 75 degrees. A particularly preferred angle $\alpha$ is approximately 55–65 degrees, and most particularly 60 degrees. This modification of the leg backface 18 and shirttail 14 results in a thicker, more robust shirttail that has sufficient depth to accommodate a seal such as that shown at 40. While the preferred embodiments include a backface canted at an angle a that is less than 90 degrees, it will be understood that a could alternatively be greater than 90 degrees. This embodiment is not preferred, however, because it reduces the thickness of the shirttail and the amount of space available for receiving a seal.

Figure 3A:
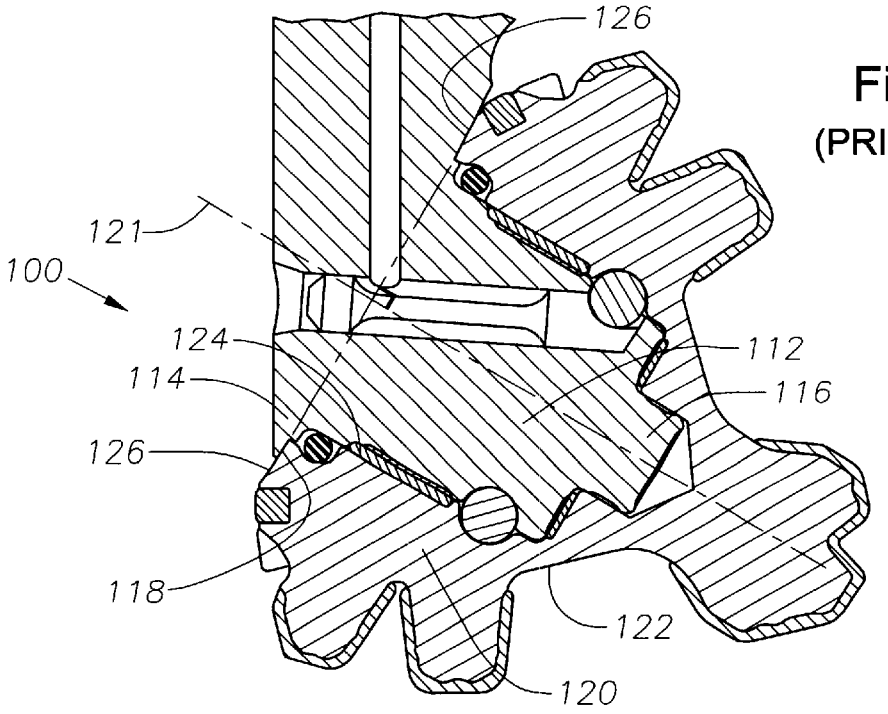
Fig. 3A (PRIOR ART)
FIGS. 3A–B are cross-sectional views of prior art bits, wherein the cone backface is not canted, the seal(s) are not canted, and the shirttail is not recessed.
Figure 3B:
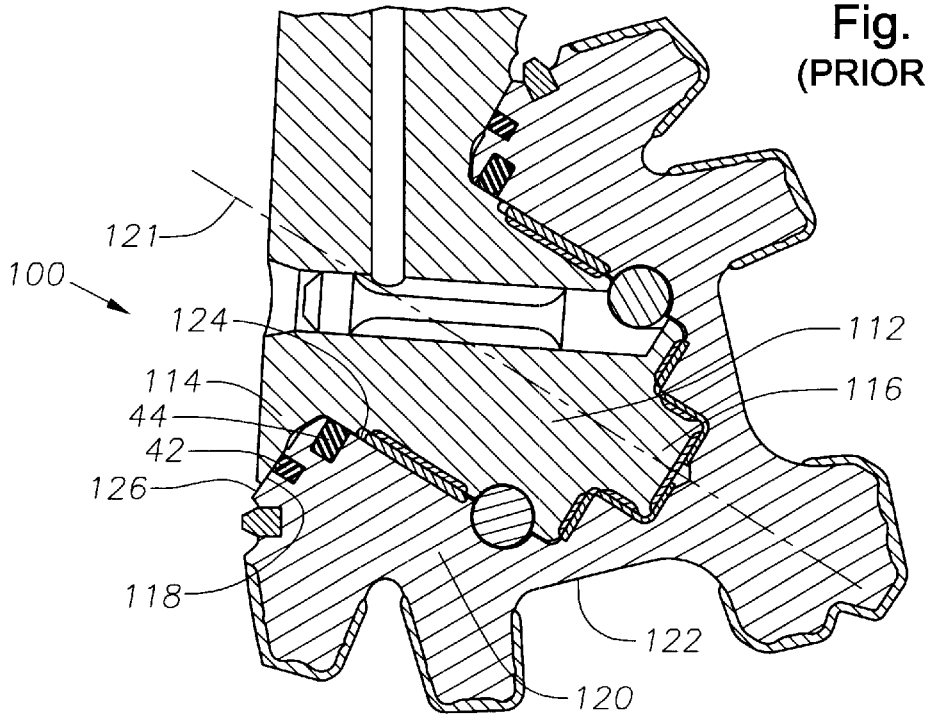
Fig. 3B (PRIOR ART)

Referring briefly to FIG. 3A for comparison, a known bit 100 includes a journal segment 112, a shirttail 114 and a bearing end 116. Shirttail 114 includes a leg backface 118. Similarly, cone 120 includes a generally conical outer surface 122, a stepped inner journal surface 124, and a cone backface 126. In contrast to the bit shown in FIG. 1, however, leg backface 118 lies in a plane that is normal to bearing axis 121 as shown at 113. This in turn means that shirttail 114 is thinner and there is less room for a seal to be positioned thereon. Either the seal must be omitted, as shown in FIG. 3A, or space must be made to accommodate it. As shown in FIG. 3B, seals 42 and 44 can be accommodated by decreasing the diameter of the journal segment 112 and cone inner surface relative to the diameter of cone outer surface 122. This has the undesired effect of weakening journal segment 112. By canting the leg backface 18 as shown in FIGS. 1 and 2, this undesired weakening can be avoided while still allowing placement of one or more seals 40.

Referring again to FIGS. 1 and 2, it can be seen that seal 40 is also canted with respect to the bearing axis 21 and is received in a correspondingly canted groove 55. In this embodiment, groove 55 is deep enough and wide enough to receive the seal 40 with an intended degree of compression of seal 40. According to a preferred embodiment, the operating axis 41 of seal 40 defines an angle $\beta$ with respect to the bearing axis 21, where $\beta$ is preferably between 10 and 85 and more preferably either between 15 and 45 degrees or between 70 and 85 degrees. The term "operating axis" relates to a cross section of the seal and is defined herein to mean the line 41 (as drawn) along which the seal is designed to be compressed during operation of the bit. According to the present invention, the operating axis 41 and the backface line 25 need not be normal. Likewise, according to the present invention, it is not necessary that the seal axis 41 be either parallel or perpendicular to the bearing axis 21.

In FIGS. 1 and 2, the features of the present invention can be used with a non-recessed shirttail 14, such as is known in the art and described below. As further discussed in detail below, they can be used to equal advantage with a recessed shirttail. Similarly, although the bits illustrated herein have cone backfaces that echo the configuration of the leg backfaces, the present invention does not require that the cone faces be canted to the same degree as the leg backfaces, or that they be canted at all.

Figure 4:
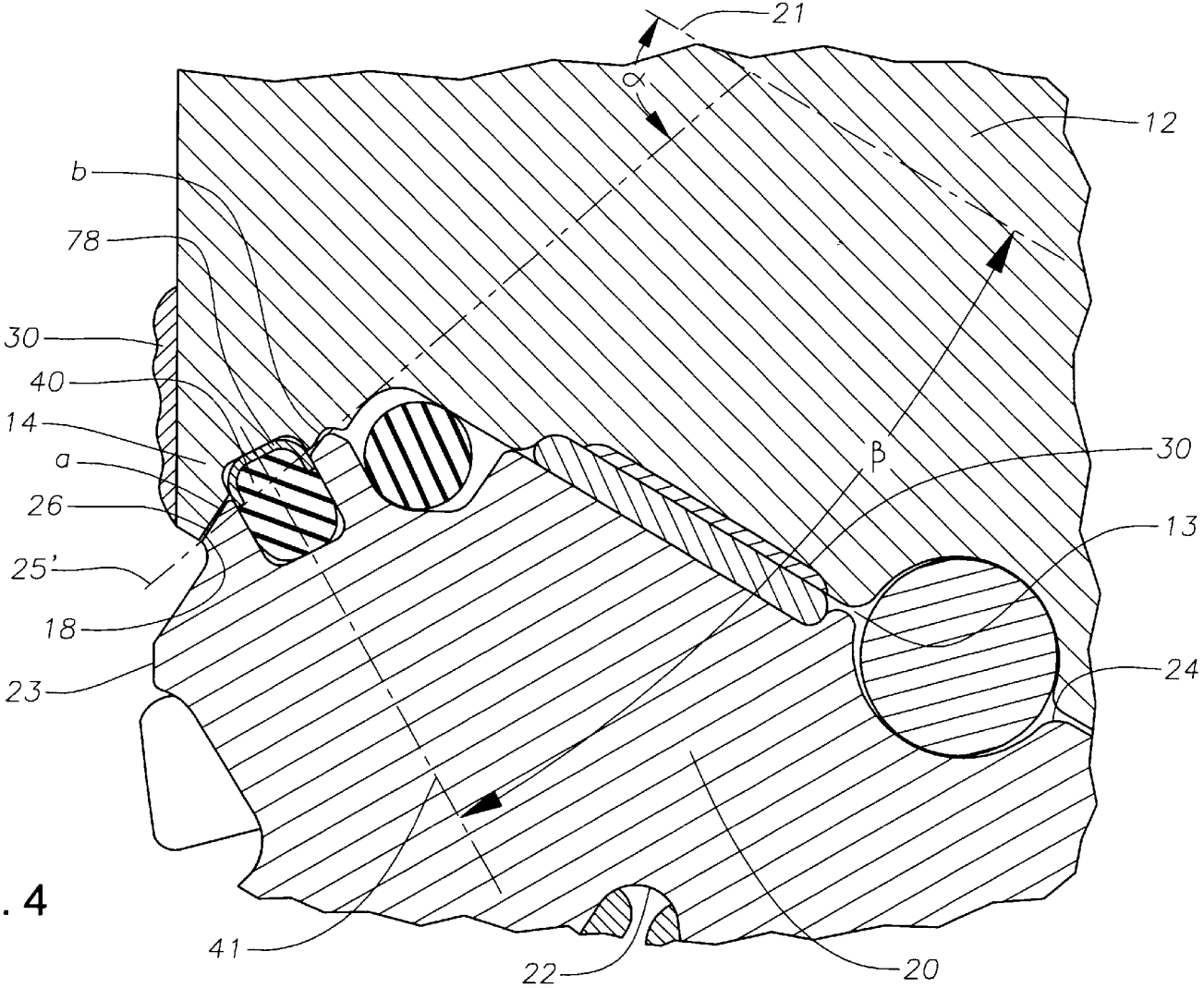
FIG. 4 is a cross-sectional view of a bit leg and associated cone constructed in accordance with a preferred embodiment, wherein the leg backface is stepped, the seal is canted, and the seal is semi-encapsulated.

Referring now to FIG. 4, in a more preferred embodiment, the cone backface 26 and corresponding leg backface 18 each include a change in axial position across a radius of the cone. In this case, however, each backface is "stepped," which means that it comprises at least two non-canted portions a, b, which are axially offset from each other along the bearing axis 21. In FIG. 4, seal 40 is again canted with respect to the bearing axis 21 by an angle $\beta$, as described above. In this embodiment, backface line 25' is defined by drawing a line between the outer edge of portion a to the inner edge of portion b. As described in the following paragraph, the seal of FIG. 4 is preferably semi-encapsulated.

Figure 5:
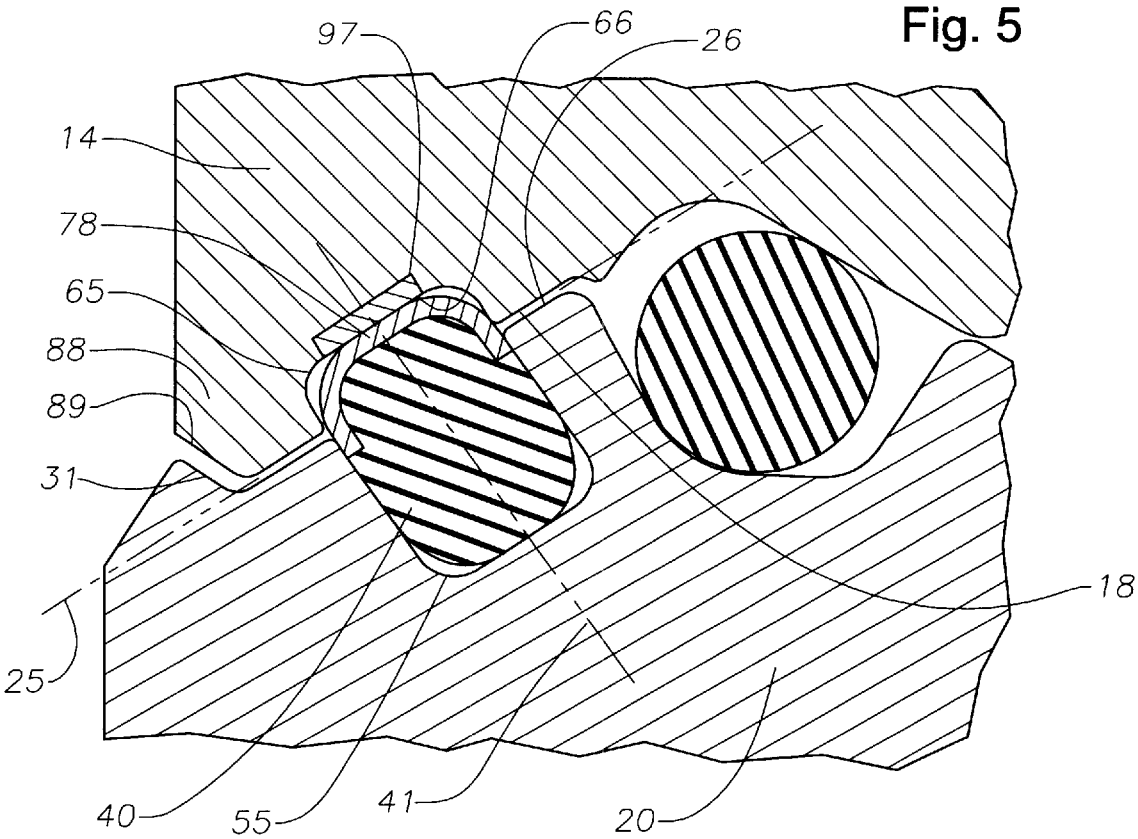
FIG. 5 is an enlarged cross-sectional view of a second alternative embodiment of a seal between a bit leg and cone, wherein the leg backface is canted and the seal is semi-encapsulated and comprises a fabric seal.

Referring now to FIG. 5, a preferred configuration for seal 40 comprises an elongate fabric seal that is received jointly in an annular groove 55 in cone 20 and a corresponding annular cut-out 65 in leg shirttail 14. Groove 55 is preferably aligned with the operating axis 41 of seal 40, and is therefore normal to the cone backface 26. In instances where seal 40 is canted with respect to backface line 25, however, groove 55 is preferably aligned with seal 40 and is not normal to backface 26. Cut-out 65 ensures that no straight-line path exists by which particles can cross seal 40. Like groove 55, the sealing surface 66 of cutout 65 is preferably normal to the seal axis 41. In one preferred embodiment, the sealing surface 66 of cut-out 65 includes a wear resistant insert 97. The seal configuration illustrated in FIG. 5 can be applied to advantage to the various embodiments of the present invention, such that the portion of surface 18 against which seal 40 bears can be recessed and/or include a wear resistant insert or inlay 97.

For ease of reference, a seal that is received partially in the cone and partially in the shirttail in the manner of FIG. 5 is referred to herein as a "semi-encapsulated" seal. Semi-encapsulated seals can be canted or not canted with respect to either the leg backface 18 or the bearing axis 21.

The embodiment of FIG. 5 also includes a recessed shirttail 88, wherein the lower edge of shirttail 88 is received in and protected by the cone 20. As shown, the leading edge of the shirttail is formed with a flat surface 89 and the cone 20 includes an annular lip 31 surrounding the cone backface surface 26. As a result, shirttail 14 is protected on its leading edge from contact with the borehole wall, thereby reducing its susceptibility to abrasive wear and fracture. Terminating the shirttail in an obtuse angle shown in FIG. 5 instead of the relatively sharp lower edge shown in FIG. 2 significantly reduces breakage of the shirttail and prolongs the useful life of the bit. The recessed shirt also protects the gap between the cone and the leg, preventing debris from entering the gap or air groove and contaminating the seal. Conventional shirttails tend to erode from their tips and expose components such as seals and bearing elements. By relieving the shirttail in the manner described herein, the cone itself will protect the shirttail. As stated above, the present invention can be used with or without a recessed shirttail.

Figure 6:
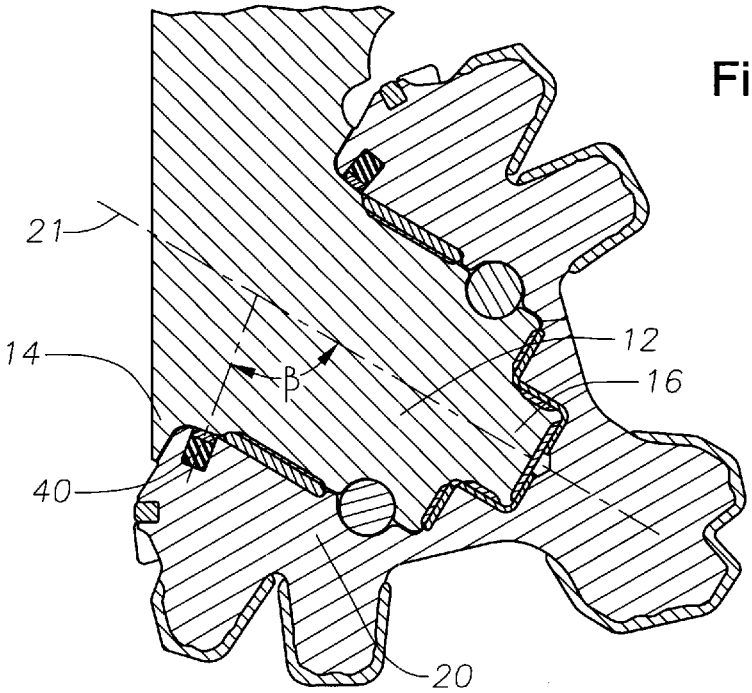
FIG. 6 is cross-sectional view of a bit leg and associated cone constructed in accordance with an alternative embodiment, wherein the seal is received in a groove in the cone, and is canted so as to be nearly perpendicular to the bearing axis of the cone.

Referring finally to FIG. 6, an alternative embodiment of the present invention includes a seal 40 that is canted so that the angle β between its operating axis 41 and the bearing axis 21 is in the range of 45 to 85 degrees and more preferably 75 to 85 degrees. As with previously described embodiments, this embodiment provides the advantage of a seal that has a reduced effect on the amount of available bearing space and has both radial and axial activation vectors.

The canted backface disclosed herein provides various advantages. For example, a canted backface rotary cone rock bit can be configured to have a thicker leg shirttail 14 tan, conventional rotary cone rock bits. The thicker shirttail is stronger and, with all other variables equal, should withstand greater impact loading than prior art or conventional bits. The more robust, stronger shirttail 14, and particularly the shirttail tip, is likely to last longer and assist in protecting the bearing seal, or seals, longer. The thicker shirttail tip 14 afforded by the present invention also provides more wear protection and provides sufficient support for a greater amount of shirttail tip hard facing 30 on the outer surface of shirttail 14.

Furthermore, the present bit can be formed so that a greater portion of the shirttail 14 has a reduced carbon content as compared to prior art shirttails. Carbon migration into the shirttail, particularly the shirttail tip, occurs during the carbonizing/heat treatment process. Hard facing 30 welded to the shirttail tip also may provide a source for carbon that can carbonize the shirttail tip. Because carbon adds wear resistance but increases brittleness, a shirttail that is not carbonized throughout its entire shirttail tip area will withstand higher impact loads.

If desired, another advantage of the thicker shirttail is that wear resistant inserts or other devices can be inlaid, or formed, into the outer surface of the legs thicker shirttail and closer to the shirttail tip, as compared to prior art shirttails. Yet another potential advantage of the thicker shirttail is that it will, if desired, allow the placement of wear rings, such as wear ring 97 of FIG. 5, or other mechanisms for the outer seal to engage. The use of such devices assists in preventing wear to the seal and leg sealing surface.

The use of a canted backface allows the placement of one or more outer, or secondary, bearing seal(s), if desired. Thus, in another aspect, the present invention includes a dual bearing seal configuration with a canted backface, such as shown, for example in FIG. 1. Dual seal configurations and related technology are disclosed in U.S. patent application Ser. No. 09/201,614, entitled "Dual-Seal Drill Bit Pressure Communication System" and filed on Nov. 30, 1998, now U.S. Pat. No. 6,196,339 and U.S. patent application Ser. No. 08/982,081 entitled "Sealed Bearing Drill Bit With Dual Seal Configuration" and filed on Dec. 1, 1997 now U.S. Pat. No. 6,033,117, both having a common assignee as the present application and both of which are hereby incorporated by reference in their entireties.

This aspect of the present invention has various advantages. First, dual seals can be included in the bit without weakening the leg shirttail. Further, in some sized bits, an outer or secondary seal of a non-canted design could not be included because of the limited area in the bit. Another advantage is that the outer seal can be both axially and radially energized. For example, the seal 40 of FIGS. 1, 3, and 4 is partially radially and partially axially energized. Effectiveness of the secondary seal is enhanced by having a radially energized component because radial energization provides less contact pressure fluctuation of the sealing face caused by axial cone movement. Axial cone movement is inherent in roller cone bits. Similarly, by including an axial component in the direction of energization, seal 40 can be made less susceptible to relative lateral movement of the cone and leg.

The construction, orientation, shape, configuration and location of the primary seal and the secondary seal 40 can take any suitable form. In FIGS. 2 and 5, for example, the seal 40 is an elongated, or bullet, O-ring seal having a fabric inlay 78 on an outer portion of the seal. Examples of fabric seals that are suitable for use in the present invention are disclosed and described in detail in U.S. Pat. No. 5,842,700. In FIG. 5, the seals 40 are elongated O-ring seals having fabric inlays 78 across their wear faces and partially along the adjacent sides. By way of further example only, seal 40 could be a dual-elastomer seal, and could include fabric, metal or other material components, could be a wiper or scraper seal, also referred to as an excluder, or a combination seal, such as a metal face or half-cat seal or a seal having any other form or configuration. A wiper or scraper seal is generally a non-positive, seal that excludes debris from passing the seal and entering the bearing system.

Likewise, the canted seal of the present invention is useful, for example, as an outer seal with the canted backface of the present invention. This allows the use of a dual seal configuration without sacrificing bit integrity and with a secondary seal that is partially axially and partially radially energized. However, it should be understood that the canted seal is not limited to being used with the canted backface or any other aspect of this invention and may be used in other configurations.

It should further be understood that the present invention does not require that all or any particular combination of the above features be used together. They may each be used independently of the others, and with other features, such as a pressure communication system or device, wear rings or similar devices. For example, the canted backface, semi-encapsulated seal, and canted seal can each be used alone or in combination. Similarly, the canted seal and canted backface disclosed herein can be used in combination with either TCI or mill tooth bits, such as are known in the art. Likewise, various portions of the present bit can be coated with one or more layers of hardfacing material, or may have one or more wear resistant inserts embedded therein. Surfaces where this may be particularly desirable are typically the wear surfaces of the bit, including the inner and/or outer surfaces of the shirttail, and the cone backface.

It is further contemplated that one or more of seal 40 and any additional seals that are used between cone 20 and leg 10 may be non-sealing members such as wiper rings or the like, rather than elastomeric sealing members.

While various preferred embodiments of the invention have been shown and described, modifications thereof can be made by one skilled in the art without departing from the spirit and teachings of the invention. The embodiments described herein are exemplary only, and are not intended to limit the scope of the invention. For example, the combinations of features described herein, and the dimensions, configuration, relative positioning and structure of the components themselves, can each be modified in accordance with known principles.

What is claimed is:

1. An earth-boring bit for drilling a borehole, the bit comprising:

a bit body, said body having at least one leg having a journal segment extending inwardly and downwardly therefrom, said leg including a shirttail, said shirttail having an outer surface and a leg backface;

at least one rolling cone cutter rotatably mounted on said bit body and having a bearing axis, a generally conical outer surface and a cone backface, said cone backface defining an interface with said leg backface; and a seal positioned in said interface, wherein said seal has a frustoconical sealing surface in sealing contact with said journal segment;

said leg backface being canted at an angle of between 35 and 85 degrees with respect to the bearing axis.

2. The bit according to claim 1 wherein said backface is canted at an angle of between 45 and 75 degrees with respect to the bearing axis.

3. The bit according to claim 1 wherein said cone backface is frustoconical.

4. The bit according to claim 1 wherein said shirttail is recessed.

5. The bit according to claim 1 wherein said shirttail is not recessed.

6. An earth-boring bit for drilling a borehole, the bit comprising:

a bit body, said body having at least one leg having a journal segment extending inwardly and downwardly therefrom, said leg including a shirttail, said shirttail having an inner surface, an outer surface and a canted leg backface;

at least one rolling cone cutter rotatably mounted on said bit body and having a generally conical outer surface and a cone backface, said backface defining an interface with said shirttail inner surface; and a seal positioned in said interface, wherein said seal has an operating axis and said operating axis is not normal to said canted backface.

7. The bit according to claim 6 wherein sad shirttails recessed.

8. The bit according to claim 6 wherein said shirttail is not recessed.

9. The bit according to claim 6 wherein said seal is a non-positive seal.

10. An earth-boring bit for drilling a borehole, the bit comprising:

a bit body, said body having at least one leg having a journal segment extending inwardly and downwardly therefrom, said leg including a shirttail, said shirttail having an inner surface, an outer surface and a leg backface;

at least one rolling cone cutter rotatably mounted on said bit body and having a bearing axis, a generally conical outer surface, and a backface, said backface defining an interface with said leg backface; and a canted seal positioned in said interface, said seal having an operating axis that is canted with respect to said bearing axis.

11. The bit according to claim 10, further including a second seal positioned between said journal segment and said cone.

12. The bit according to claim 11 wherein said second seal is canted.

13. The bit according to claim 10 wherein said leg backface is canted.

14. The bit according to claim 10 wherein said shirttail is recessed.

15. The bit according to claim 10 wherein said shirttail is not recessed.

16. The bit according to claim 10 wherein said leg backface is normal to said bearing axis.

17. The bit according to claim 10 wherein said seal operating axis is canted at an angle of between 15 and 45 degrees with respect to said bearing axis.

18. The bit according to claim 10 wherein said seal operating axis is canted at an angle of between 70 and 85 degrees with respect to said bearing axis.

19. The bit according to claim 10 wherein said seal is received in a groove in said cone and bears on said leg backface.

20. The bit according to claim 10 wherein said seal is received partially in a groove in said cone and partially in a cut-out in said leg backface.

21. The bit according to claim 10 wherein said seal is a non-positive seal.

22. An earth-boring bit for drilling a borehole, the bit comprising:

a bit body, said body having at least one leg having a journal segment extending inwardly and downwardly therefrom, said leg including a shirttail, said shirttail having an outer surface and a leg backface;

at least one rolling cone cutter rotatably mounted on said bit body and having a bearing axis, a generally conical outer surface, and a backface, said backface defining an interface with said leg backface;

a canted seal positioned in said interface, said seal having an operating axis that is canted with respect to said bearing axis; and said seal has an elongate cross-section and includes a fabric inlay on its wear face.

23. An earth-boring bit for drilling a borehole, the bit comprising:

a bit body, said body having at least one leg having a journal segment extending inwardly and downwardly therefrom, said leg including a shirttail, said shirttail having an outer surface and a leg backface;

at least one rolling cone cutter rotatably mounted on said bit body and having a bearing axis, a generally conical outer surface, and a backface, said backface defining an interface with said leg backface;

a canted seal positioned in said interface, said seal having an operating axis that is canted with respect to said bearing axis;

said seal is received in a groove in said cone and bears on said leg backface; and said leg backface includes a wear resistant insert.

24. An earth-boring bit for drilling a borehole, the bit comprising:

a bit body, said body having at least one leg having a journal segment extending inwardly and downwardly therefrom, said leg including a shirttail, said shirttail having an outer surface and a leg backface;

at least one rolling cone cutter rotatably mounted on said bit body and having a bearing axis, a generally conical outer surface, and a backface, said backface defining an interface with said leg backface;

a canted seal positioned in said interface, said seal having an operating axis that is canted with respect to said bearing axis;

said seal is received partially in a groove in said cone and partially in a cut-out in said leg backface; and said cut-out includes a wear resistant insert.

25. An earth-boring bit for drilling a borehole, the bit comprising:

a bit body, said body having at least one leg having a journal segment extending inwardly and downwardly therefrom, said leg including a shirttail, said shirttail having an outer surface and a leg backface;

at least one rolling cone cutter rotatably mounted on said bit body and having a bearing axis, a generally conical outer surface and a cone backface, said cone backface defining an interface with said leg backface;

at least two or more independent seals;

at least one of said seals having a frustoconical sealing surface on the journal; and said leg backface being canted at an angle of between 35 and 85 degrees with respect to the bearing axis.

26. The bit according to claim 25 wherein said leg backface is canted at an angle of between 45 and 75 degrees with respect to the bearing axis.

27. The bit according to claim 25 wherein said cone backface is frustoconical.

28. The bit according to claim 25 wherein said shirttail is recessed.

29. The bit according to claim 25 wherein said shirttail is not recessed.

* * * * *